United States Patent [19]

Nicholson

[11] 4,355,701

[45] Oct. 26, 1982

[54] LADDER

[76] Inventor: Agnew W. Nicholson, 21 Nipigon Ave., Willowdale, Ontario, Canada

[21] Appl. No.: 178,909

[22] Filed: Aug. 18, 1980

[51] Int. Cl.[3] ..... E06C 9/10

[52] U.S. Cl. ..... 182/97; 182/100; 182/189; 182/207

[58] Field of Search ..... 182/100, 97, 189, 91, 182/92, 86, 85, 207; 248/110, 225.2

[56] References Cited

U.S. PATENT DOCUMENTS

| | | | |
|---|---|---|---|
| 2,022,881 | 12/1935 | Conway | 182/97 |
| 2,611,466 | 9/1952 | Biggert | 182/97 |
| 3,212,271 | 10/1965 | Tibbetts | 248/110 |
| 3,512,608 | 5/1970 | Huntley | 182/189 |
| 3,999,627 | 12/1976 | Naka | 182/100 |

FOREIGN PATENT DOCUMENTS

| | | | |
|---|---|---|---|
| 51203 | 10/1966 | German Democratic Rep. | 182/189 |
| 743995 | 1/1956 | United Kingdom | 182/97 |

*Primary Examiner*—Reinaldo P. Machado
*Attorney, Agent, or Firm*—Browdy and Neimark

[57] ABSTRACT

A ladder assembly includes a supporting bracket to pivotally mount one end of a ladder member; the ladder member comprises an elongated support member which suitably comprises a tubular pole, and a plurality of spaced apart rung members extending transversely of the support member to form rung members on opposite sides of the support member; the rung members are suitably tubular with grip sleeves over at least a portion of their outer surface to minimize hand and foot slippage. The ladder assembly may be particularly adapted for a marine vessel, access to hydropoles and escape from high buildings.

13 Claims, 7 Drawing Figures

LADDER

BACKGROUND OF THE INVENTION (a) Field of the Invention

This invention relates to a ladder and more particularly to a compact ladder assembly in which the ladder can be readily pivotally moved from a raised to a lowered position.

(b) Description of the Prior Art

Ladders are employed in a variety of environments to permit ascent and descent.

In marine vessels it is customary to mount a ladder on the transom at the stern of the vessel by means of which persons in the water, who may, for example, have been swimming, can board the vessel.

Such marine ladders conventionally comprise a pair of spaced apart, parallel elongated support arms with rungs extending therebetween.

A problem arises in that such conventional marine ladders are bulky and their location on the transom at the stern presents problems in some cases. For example, in many vessels, the rudder mounted at the stern is adapted to be raised. In this case the marine ladder must be mounted so as not to obstruct the movement or securing of the rudder in any position.

Other marine accessories and equipment may also be located at the stern and it is necessary that access to these not be impeded by the location of the marine ladder.

Marine vessels frequently include insignia on the stern of the vessel and it is necessary that such insignia not be obscured by the marine ladder.

These several requirements and the bulkiness of conventional marine ladders thus presents difficulties in satisfactorily locating the marine ladder, without the disadvantage indicated arising.

It is also desirable to provide a ladder assembly in other environments, which is relatively compact, but secure, for example, to provide escape from high buildings, or between floors of high buildings so as to reach a floor below the fire in a high building.

It is likewise desirable to provide a ladder assembly in which, in use, the ladder is firmly mounted, but which can be removed so as to prevent ascent of unauthorised persons. In particular such a ladder assembly is desirable for access to upper regions of hydro poles or telephone poles.

It is an object of this invention to provide a ladder assembly which is less bulky than conventional ladders, for a variety of uses.

It is another object of this invention to provide a ladder assembly in which the ladder is firmly supported in use and wherein the ladder can be pivoted about its upper end to a raised position, or readily removed when not in use.

It is a particular object of this invention to provide a marine ladder assembly.

It is a more particular object of this invention to provide a marine ladder assembly which is less bulky and has a lower weight to length ratio than conventional marine ladders made of comparable materials.

It is yet another object of this invention to provide a ladder assembly which can be readily lengthened, as required, by additional ladder elements.

SUMMARY OF THE INVENTION

The invention provides a ladder assembly which includes a supporting bracket to firmly and securely mount the upper end of a ladder member in use, in which the ladder member comprises an elongated support member with rungs extending transversely thereof.

In particular the invention provides a ladder assembly including a ladder member and a supporting bracket to mount the assembly on a structure. The ladder member comprises an elongated support member having first and second ends, a first plurality of spaced apart parallel rungs extending transversely of the support member in a first direction and a second plurality of spaced apart parallel rungs extending transversely of the support member in a second direction opposite to said first direction. A hinge means on the first end of the support member hingedly mounts the ladder in a supporting bracket.

The supporting bracket includes a load bearing surface adapted to support the ladder member and a load on the rungs thereof, when the ladder member is in a lowered position extending generally downwardly from the supporting bracket.

The rungs suitably include grip means over at least a portion of their outer surface. The grip means permit the ladder member to be readily ascended or descended without hand or foot slippage.

In the case of a marine ladder assembly the grip means should not become unduly slippery when wet.

Suitably the grip means may comprise non-slip, rubber sleeves which are heat shrunk onto the rungs.

It will be understood that the rungs are appropriately spaced, as in conventional ladders, to facilitate ascent and descent on the ladder.

The ladder assembly suitably includes guides whereby the ladder member is firmly positioned in the supporting bracket with minimal lateral movement so as to provide a firm ladder structure.

The ladder assembly may be adapted for ladder members of various lengths, where a lengthy ladder is required the ladder member may be fabricated as a single unitary structure or it may be composed of a short ladder member as described and a plurality of ladder elements, which are similar to the ladder member, but which have similar first and second ends, and do not include the hinge means on the first end as in the ladder member which is mounted to the supporting bracket.

In another aspect of the invention there is provided a ladder member for a ladder assembly of the invention.

The ladder assembly of the invention can be manufactured as a compact unit which occupies little space and, in the case of a marine ladder assembly, does not present a major obstruction to insignia on the stern of the vessel.

BRIEF DESCRIPTION OF THE DRAWINGS

The invention is illustrated in particular and preferred embodiments by reference to the accompanying drawings in which.

DESCRIPTION OF THE PREFERRED EMBODIMENTS WITH REFERENCE TO THE DRAWINGS

Figure 1:
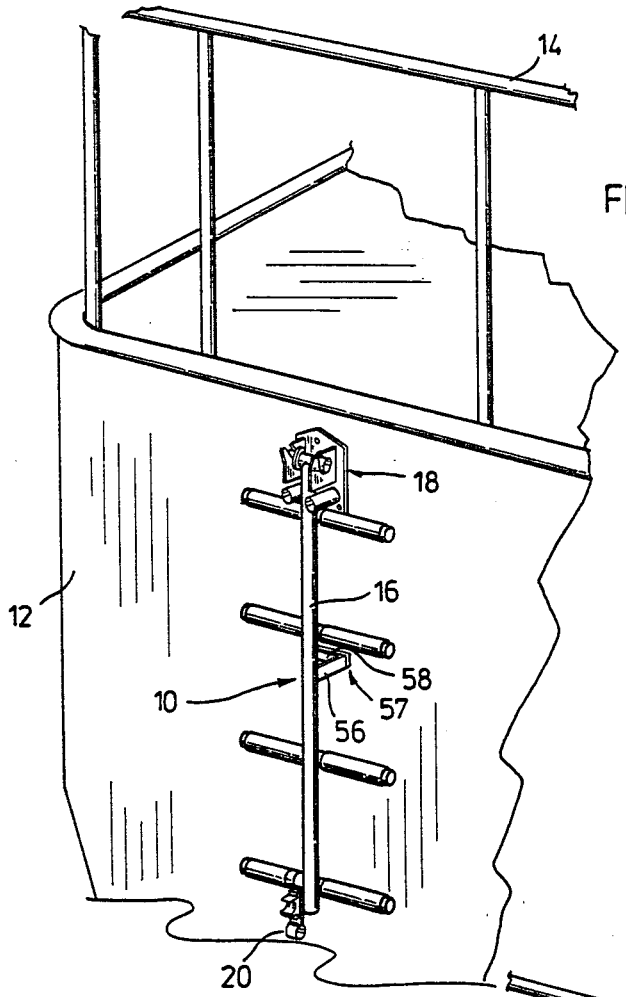
FIG. 1 shows a ladder assembly of the invention mounted on the stern of a boat, with the ladder in the lowered position.
Figure 2:
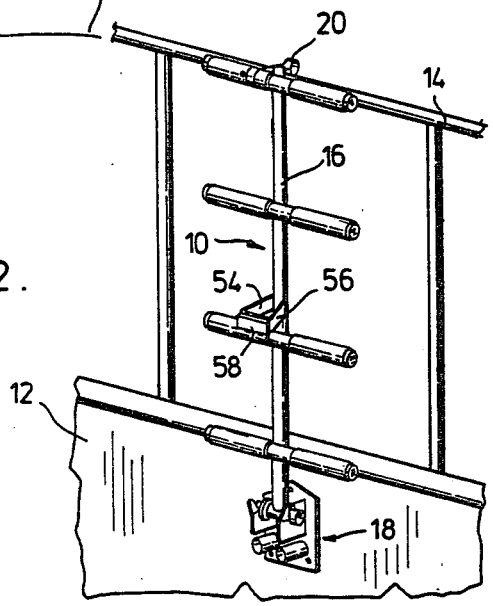
FIG. 2 shows the assembly of FIG. 1 with the ladder in the raised position.

With further reference to FIGS. 1 and 2 there is illustrated schematically a ladder assembly 10 mounted on the transom 12 of a boat (partially shown) having a stern rail 14.

The ladder assembly 10 includes a ladder member 16, a supporting bracket 18 and a clasp 20.

In the configuration illustrated in FIG. 1, the ladder member 16 is in the lowered position extending towards the water whereby persons in the water can climb ladder member 16 to board the boat.

In the configuration illustrated in FIG. 2, the ladder member 16 is shown in the raised position wherein it is secured by clasp 20 to the stern rail 14.

Figure 3:
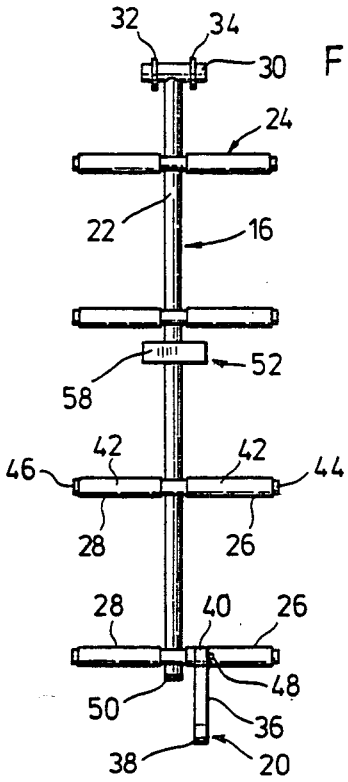
FIGS. 3 and 4 shows the ladder member of a ladder assembly of the invention.
Figure 4:
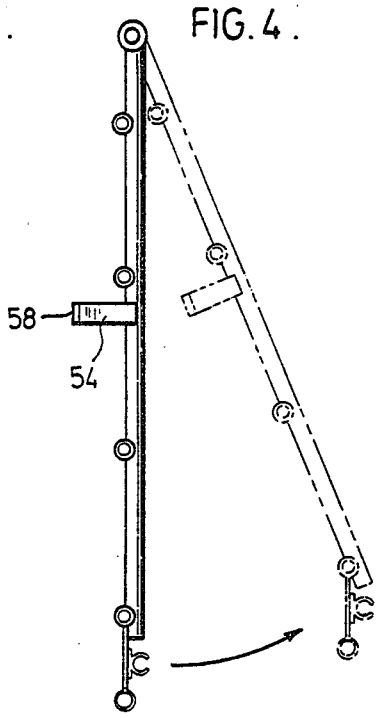
Figure 5:
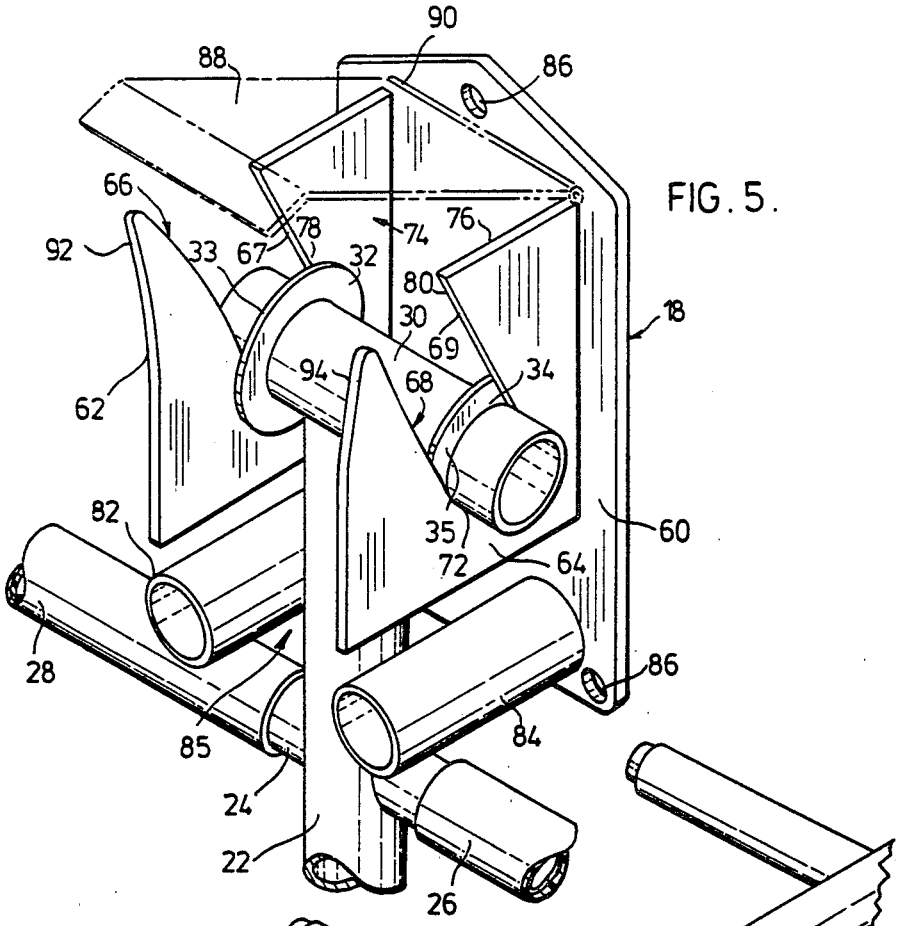
FIG. 5 shows a supporting bracket of a ladder assembly of the invention.

With further reference to FIGS. 3, 4 and 5, the ladder member 16 includes a tubular pole 22, tubular rung members 24, a hinge tube 30 at one end and the clasp 20 at the other end.

The rung members 24 are mounted transversely of the pole 22 and define a plurality of tubular rungs 26 extending outwardly of pole 22 and a plurality of tubular rungs 28 extending outwardly of pole 22 in a direction opposite to the rungs 26.

Heat shrunk rubber sleeves 42 cover the major outer surface of each of the rungs 26 and 28.

The tubular rungs 26 and 28 are closed at their outer ends by caps 44 and 46 respectively.

Spaced apart guide discs 32 and 34 are mounted circumferentially on hinge tube 30, one on either side of pole 22, and include outwardly facing guide walls 33 and 35.

Clasp 20 includes a clasp arm 36, a clasp member 38 and a cylindrical mounting end 40 to pivotally mount clasp 20 on a lowermost rung 26.

A stop 48 on the lowermost rung 26 retains the cylindrical mounting end 40 of clasp 20 on the lowermost rung 26.

The end of pole 22 adjacent clasp 20 is closed by a cap 50.

A stand-off 52 which includes side walls 54 and 56 and an end wall 58 extends inwardly from pole 22.

With further reference to FIG. 5, a supporting bracket 18 comprises a base 60 and a pair of spaced apart bracket arms 62 and 64.

A U-shaped slot 66 in arm 62 includes a slot wall 67 dnd defines a pivoting and load-bearing surface 70 (not visible); a similar U-shaped slot 68 in arm 64 includes a slot wall 69 and defines a corresponding pivoting and load-bearing surface 72.

Arms 62 and 64 include facing inner walls 74 and 76 respectively defining guide surfaces 78 and 80 respectively.

The outer ends of arms 62 and 64 include outwardly bent portion 92 and 94 respectively.

Spaced apart tubular guides 82 and 84 extend from baae 60 and are spaced vertically below arms 62 and 64 respectively and define a guide channel 85 therebetween.

Holes 86 in base 60 are used to mount supporting bracket 18 on the transom 12, (as shown in FIGS. 1 and 2).

An optional lid 88 is mounted above a pivot 90.

In mounting the ladder assembly 10 on transom 12, as illustrated in FIGS. 1 and 2, the suporting bracket 18 is first mounted on the transom 12, at a predetermined position such that in use the lowermost rungs 26 and 28 of the ladder member 16 will be adjacent the water level, and in the raised position the clasp 20 will engage the stern rail 14 of the boat.

The hinge tube 30 of a ladder member 16 is inserted into the U-shaped slots 66 and 68 so that the guide walls 33 and 35 of guide discs 32 and 34 abut the guide surfaces 78 and 80 on inner walls 74 and 76 respectively of the arms 62 and 64.

The outer bent over portions 92 and 94 of arms 62 and 64 facilitate insertion of the hinge tube 30 with guide discs 32 and 34 into the slots 66 and 68.

With the ladder member 16 in the lowered position the tubular pole 22 extends through the guide channel 85 between the tubular guides 82 and 84 with a close fit, and this serves to reduce any tendency for lateral movement of ladder member 16 during use.

In the lowered position the ladder member 16 is held outwardly from the transom 12 by the stand-off 52, with end wall 58 abutting the transom 12. In this way the ladder member 16 is supported away from the transom 12 at a slight angle to the vertical thereby facilitating ascent and descent on the ladder member 16. This angle is typically about 5° to the vertical.

The sleeves 42 provide a gripping surface on the tubular rungs 26 and 28, even when wet, whereby satisfactory hand-hold and foot-hold can be achieved when ascending on descending ladder member 16, without slippage.

The weight of ladder member 16 and the load of a person ascending or descending the ladder when in the lowered position, is borne by the surfaces 70 and 72 in slots 64 and 66.

When not in use the ladder member 16 is pivoted about hinge tube 30 on surfaces 70 and 72 and is secured to the stern rail 14 clasp member 38 of the pivotally mounted clasp 20.

When the boat is docked the ladder member 16 can be completely removed from supporting bracket 18 for storage under lock against possible theft, if desired.

In the embodiment illustrated in FIG. 5, the upper open end of supporting bracket 18 is closed by the optional pivotally mounted lid 88. Lide 88 may for example, be spring loaded and weighted to close the slots 66 and 68 and may include a hasp (not shown) to secure lid 88 in a closed position on support bracket 18 and to prevent removal of ladder member 16 from slots 66 and 68 of the bracket 18.

Figure 6:
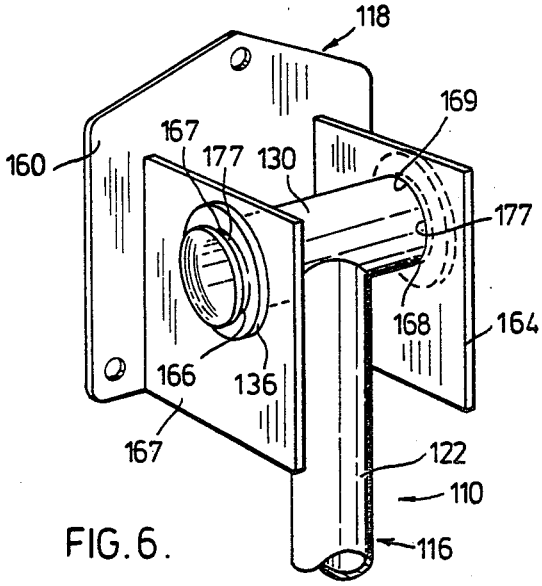
FIG. 6 shows a portion of a ladder assembly of the invention in yet another embodiment.

With further reference to FIG. 6, there is illustrated in a different embodiment a ladder assembly 110 of the invention, which includes a ladder member 116 (part of which is shown) and a supporting bracket 118.

The ladder member 116 includes a tubular pole 122, tubular rung members 124 (not shown) and a tubular hinge 130. The rung members 124 define tubular rungs 126 and 128 (not shown).

Supporting bracket 118 includes a base 160 and a pair of spaced apart arms 162 and 164 having apertures 166 and 168 therethrough respectively.

Apertures 166 and 168 include aperture walls 167 and 169 which define pivoting and load-bearing surfaces 170 and 172.

Ladder member 116 is mounted in bracket 118 so that tubular hinge 130 extends through apertures 166 and 168, whereafter the outer ends of tubular hinge 130 are subjected to a metal working operation to provide abutments 136 to retain ladder member 116 hingedly mounted in bracket 118.

The ladder assembly 110 of FIG. 6 is otherwise the same as ladder assembly 10 illustrated in FIGS. 1 to 4.

FIGS. 1 to 6 illustrate ladder assemblies of the invention which comprise a ladder member formed as a single unit. It is also within the invention to provide one or more ladder elements which can be securely connected to a ladder member 16 or 116 to form an extended ladder.

Figure 7:
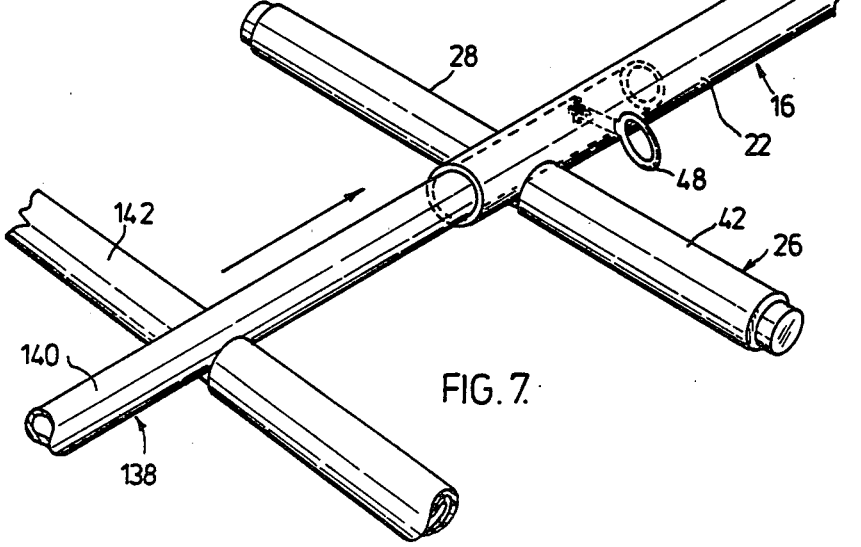
FIG. 7 shows a portion of an extendable ladder assembly of the invention.

With further reference to FIG. 7 there is illustrated a means of forming an extended ladder. In FIG. 7 the ladder element 138 comprises a tubular pole 140 and tubular rung members 142 and is shown connected to tubular pole 22 of a ladder member 16 as illustrated in FIG. 3.

In order to assemble ladder member 16 and ladder element 138, the cap 50 of ladder member 16 is omitted.

Tubular pole 140 has an outer diameter which is slightly less than the inner diameter of tubular pole 22, whereby tubular pole 140 can be inserted into tubular pole 22.

Tubular poles 22 and 140 are secured together by means of a pin 48 passing through aligned holes 144 and 146 in tubular poles 22 and 140 respectively. In this way a strong male/female connection is formed between ladder member 16 and ladder element 138 which is in fact stronger in the region of the connection than tubular pole 22 or tubular pole 140 alone.

Additional ladder elements (not shown) can be connected to the free end of ladder element 138, and so on, whereby an extended ladder can be produced.

The ladder assembly of the invention can be readily made from stainless steel with the tubular pole 22, the tubular rung members 24, the hinge tube 30 and the tubular guides 82 and 84 of the assembly in FIGS. 1 to 4 all being manufactured from stainless steel tubing. In particular the parts may be manufactured from 304 grade steel or in the case of sea-going vessels from 316 grade steel.

The rung members 24 are suitably milled about the midpoint of their longitudinal axis to define a curved slot to mate with the outer curved surface of tubular pole 22, whereafter the rung members are welded to pole 22.

It is envisaged that caps 44 and 46 on rungs 26 and 28 may be replaced by disc-shaped members to ensure greater security, against lateral slip, for a person using the ladder.

Although the ladder assembly of the invention has been particularly described by reference to a marine ladder assembly for mounting on the stern of a boat, the ladder assembly of the invention may be employed in a variety of fields.

It is envisaged that the ladder assembly of the invention and particularly an extended ladder might be employed to scale hydro poles for servicing. In this case there might suitably be employed a ladder assembly 10 as illustrated in FIGS. 3 to 4, with the supporting bracket 18 being permanently monted at an appropriate elevated position on the hydro pole with the ladder member 16 being carried from place to place by the maintainence crew and fitted into the supporting bracket 18 as required. In the case of such a ladder the clasp 20 would be omitted but might suitably be replaced by a ring member or spike by means of which the ladder might be firmly anchored into the ground for greater rigidity and support of the ladder.

It is also envisaged that ladder assemblies of the invention might be employed externally of high buildings to permit escape in the case of fire, or at least provide a means of passage to floors of the building below the location of a fire from above the location of the fire. In this case the stand-off 52 might suitably be omitted and the user of the ladder could employ a harness around his body and around the ladder member 16 to more firmly locate him on the ladder. The rung members 24 having a length comparatively short compared with the width of an average person would not provide obstruction to the movement of such a harness with descent of the individual on the ladder.

In such a case an extended ladder member 16 might be permanently installed terminating a distance above the ground with a conventional ladder being placed on the ground in the event of fire to reach the bottom of extended ladder member 16.

The ladder of the assembly of the invention could also be readily manufactured to provide registration sill by sill in high-rise office buildings or balcony by balcony in high-rise apartment buildings to provide a means of escape.

Suitably each apartment or floor of a building might be equipped with a removable ladder member 16 to be supported in a permanently mounted supporting bracket 18. Such ladder member might conveniently have a length sufficient to extend passed one or two floors externally of the building to reach a ladder assembly mounted below.

The ladder assemblies of the invention can withstand elevated temperatures of the order of 1000° C. and have successfully passed stress and tensile strength tests.

The ladder assemblies of the invention can also be employed, in view of their portability as access ladders for aircraft for crew and maintenance personnel, in particular such ladder assemblies are significantly more stable than the conventionally employed chain and rope ladders.

On the other hand the compact, non-bulky form of the ladder assembly of the invention when manufactured from stainless steel and employing 304 stainless steel tubing has a weight of only about 1 pound per foot of ladder as compared with at least 3 pounds per foot in conventional ladders fabricated using the tubular steel of the same grade.

When employed as marine ladders, the ladder assemblies of the invention thus have the advantage that they are relatively light in weight, can be temporarily mounted if desired, and take up little space.

It will be understood that a marine ladder of the invention may have a length when in the loered position, as illustrated in FIG. 1, such that it extends below the water level, whereby easier access is facilitated. In particular it is appropriate to have the ladder of a length such that it extends about 12 to about 16 inches below the water level in the lowered position.

As illustrated in FIG. 3, the clasp 20 is pivotally mounted on a lowermost rung 26. It will be understood that the clasp 20 might also be mounted on a rung other than a lowermost rung 26 or 28, for example, the second or third rung 26 or 28 from the lowermost rung 26 or 28. More particularly the clasp 20 is mounted on a rung 26 or 28 such that, in the raised position, it will readily engage the stern rail 14 or an equivalent cross bar.

For solo boat trips a fishing line, particularly a 20 lb fishing line trailing a buoy or bottle may suitably be fastened to clasp 20 whereby the ladder may be released to the lowered position in the event of a man-overboard, thereby permitting safe reboarding on solo trips.

In the case of an extended ladder such as is illustrated in FIG. 7, a passage might be provided in the ladder for circulation of a coolant, for example water or air. Further the joint strength at the connection of the tubular poles 22 and 140 may be increased by expanding or sleeving the appropriate tube, at the connection.

I claim:

1. A lightweight, compact, marine ladder assembly including:

a ladder member and a supporting bracket to mount the assembly on the stern of a marine vessel, said ladder member comprising an elongated tubular pole having first and second ends, a plurality of spaced apart tubular rung members extending transversely of said tubular pole between said first and second ends, said rung members being mounted on said tubular pole at the middle of their axial length such that each rung member forms a pair of tubular rungs extending transversely of said tubular pole, in opposite directions, said rungs including grip means over at least a portion of their outer surface to counteract hand and foot slippage, a stand-off on said tubular pole adapted to abut said stern and support said ladder member outwardly of the vessel, a tubular hinge member extending transversely of said pole on said first end, said supporting bracket comprising a base wall adapted to be mounted on the stern, and a pair of spaced apart bracket arms extending substantially perpendicularly of said base wall, said bracket arms having opposed facing inner walls, and each of said bracket arms including an arm wall defining a curved pivoting and load bearing surface for engagement with said tubular hinge member, to pivotally mount said ladder member in said supporting bracket for movement between a raised and a lowered position of the ladder member and to support the ladder member and a load on the rungs thereof, when said ladder member is in the lowered position extending generally downwardly from the supporting bracket, and guide means on said tubular hinge member to prevent lateral movement of the hinge member out of engagement with said arm walls.

2. A ladder assembly according to claim 1, further including a clasp on said ladder member adapted to releaseably secure the ladder member in a raised position, to a stern rail of said vessel.

3. A ladder assembly according to claim 2, wherein said clasp includes a clasp arm having a cylindrical end pivotally mounted about one of said tubular rungs, stop means projecting from said one tubular rung, said cylindrical end being mounted on said one tubular rung between said stop means and said tubular pole, and a clasp element on said clasp arm adapted to releaseably secure said ladder member to said stern rail.

4. A ladder assembly according to claim 3, wherein said grip means comprise rubber sleeves heat shrunk on said rungs.

5. A ladder assembly according to claim 1, wherein said curved pivoting and load bearing surfaces are defined by opposed slots in said arms, said guide means comprising:

a pair of spaced apart guide flanges extending circumferentially outwardly of said tubular hinge member each guide flange having an outwardly facing flange wall adapted to abut an inwardly facing wall of the adjacent arm bracket.

6. A ladder assembly according to claim 5, further including a pair of tubular guide members extending perpendicularly from said base wall below said bracket arms, said guide members being spaced apart to define a channel adapted to receive and limit lateral movement of said tubular pole when said ladder member is in said lowered position.

7. A ladder assembly according to claim 1, wherein said arm walls are defined by opposed apertures in said arms and said guide means comprise retaining means at the outer ends of said tubular hinge member to permanently retain said hinge member in said supporting bracket.

8. A ladder member comprising an elongated tubular pole having first and second ends, a plurality of spaced apart tubular rung members extending transversely of said tubular pole between said first and second ends, said rung members being mounted on said pole at the middle of their axial length, such that each rung member forms a pair of tubular rungs extending transversely of said tubular pole, in opposed directions, said rungs including grip means over at least a portion of their outer surface to counteract hand and foot slippage, said grip means comprising rubber sleeves heat shrunk on said rungs, a tubular hinge member extending transversely of said pole on said first end adapted to be pivotally mounted in a supporting bracket, and a pair of spaced apart guide flanges extending circumferentially outwardly of said tubular hinge member on either side of said tubular pole.

9. A ladder member according to claim 8, including a stand-off on said tubular pole adapted to abut a structure adjacent which the ladder member is mounted to support the ladder member outwardly of said structure.

10. A ladder member according to claim 8, further including a clasp on said ladder member adapted to releaseably secure the ladder member in a raised position to a bar mounted on a structure on which the ladder member is pivotally mounted.

11. A ladder member according to claim 10, wherein said clasp is pivotally retained on a rung adjacent said second end.

12. A ladder member according to claim 8, including a passage defined therein for circulation of a coolant.

13. In a marine vessel having a transom and a stern rail and a ladder assembly mounted on said transom, the improvement wherein said ladder assembly is as defined in claim 2, said supporting bracket being mounted on said transom and said clasp being adapted to engage said stern rail when said ladder member is in the raised position.

* * * * *